US008070165B1

(12) United States Patent
Stewart

(10) Patent No.: US 8,070,165 B1
(45) Date of Patent: Dec. 6, 2011

(54) EDUCATIONAL GAME AND METHOD

(76) Inventor: Elva J. Stewart, Upper Marlboro, MD (US)

( * ) Notice: Subject to any disclaimer, the term of this patent is extended or adjusted under 35 U.S.C. 154(b) by 0 days.

(21) Appl. No.: 12/660,578

(22) Filed: Mar. 2, 2010

(51) Int. Cl.
*A63F 3/00* (2006.01)

(52) U.S. Cl. ..... 273/287; 273/141 R

(58) Field of Classification Search ..... 273/287, 273/141 R, 142 R, 142 H, 142 HA, 142 JA
See application file for complete search history.

(56) References Cited

U.S. PATENT DOCUMENTS

| | | | | | |
|---|---|---|---|---|---|
| 1,211,103 | A | | 1/1917 | Devlin | |
| 1,578,632 | A | * | 3/1926 | Bommer | 273/244.1 |
| 2,655,736 | A | * | 10/1953 | Lipschitz | 434/129 |
| 3,170,696 | A | * | 2/1965 | Nielsen | 273/243 |
| 3,817,531 | A | * | 6/1974 | King et al. | 273/243 |
| 3,936,054 | A | | 2/1976 | Garcia | |
| D243,203 | S | | 1/1977 | Wilkins | |
| 4,079,945 | A | | 3/1978 | Brass | |
| 4,784,394 | A | | 11/1988 | Sumin | |
| 4,884,816 | A | | 12/1989 | Ford et al. | |
| 6,234,481 | B1 | | 5/2001 | Robertson | |
| 2007/0241500 | A1 | * | 10/2007 | D'Antonio | 273/243 |

* cited by examiner

*Primary Examiner* — Vishu K. Mendiratta

(57) ABSTRACT

An educational game includes a game board with a top side having a plurality of outer spaces forming an outer loop and a plurality of inner spaces forming an inner loop. First and second spinners are coupled to the game board. The first spinner indicates one of the outer spaces. The second spinner indicates one of the inner spaces. A plurality of outer cards is provided and each of the outer spaces has one of the outer cards positioned therein. A plurality of inner cards is provided and each of the inner spaces has one of the inner cards positioned therein. The outer cards include first information indicia and the inner cards include second information indicia. The first and second spinners are spun. The inner and outer cards indicated by the first and second spinners are read to determine if the first and second information indicia thereon match each other.

1 Claim, 3 Drawing Sheets

EDUCATIONAL GAME AND METHOD

BACKGROUND OF THE DISCLOSURE

1. Field of the Disclosure

The disclosure relates to educational games and more particularly pertains to a new educational game for teaching a person educational facts in an entertaining and competitive manner.

2. Summary of the Disclosure

An embodiment of the disclosure meets the needs presented above by generally providing a game board that has a top side and a perimeter edge. A plurality of outer spaces forms an outer loop positioned adjacent to the perimeter edge and a plurality of inner spaces forms an inner loop positioned within the outer loop. A quantity of the outer spaces is equal to a quantity of inner spaces. Point indicia are positioned on each of the outer and inner spaces. A first spinner and a second spinner each rotatably coupled to the game board. The first spinner has an end indicating one of the outer spaces and the second spinner has an end indicating one of the inner spaces. A plurality of outer cards is provided and each of the outer spaces has one of the outer cards positioned therein. The outer cards each have first information indicia thereon being unique to each outer card. A plurality of inner cards is provided and each of the inner spaces has one of the inner cards positioned therein. The inner cards each have second information indicia thereon unique to each inner card and corresponding to the first information indicia on one of the outer cards. The first spinner is spun to indicate one of the outer spaces and the outer card positioned in the outer space indicated is removed to define a removed outer card and an empty outer space. The second spinner is spun to indicate one of the inner spaces and the inner card positioned in the inner space indicated is removed to define a removed inner card and an empty inner space. The first and second information indicia on the removed outer and inner cards are read to determine if the first and second information indicia correspond with each other. A match is declared if a player believes that the first and second information indicia correspond with each other. Points are awarded to a player who correctly declares a match. The points are determined by the point indicia indicated on the empty inner and outer spaces. The game is won by a player who accumulates a preselected number of points.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
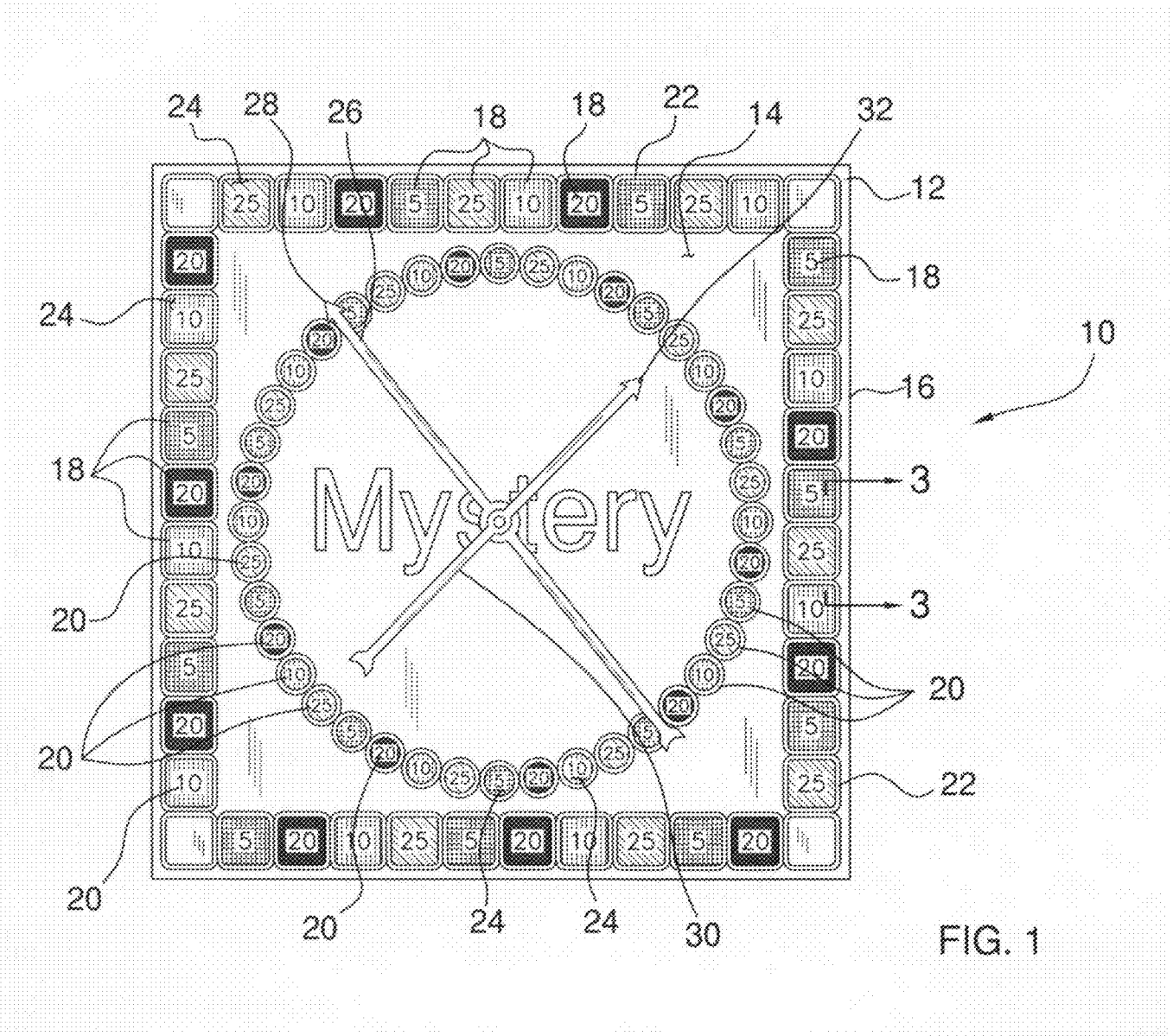
FIG. 1 is a top view of a educational game and method according to an embodiment of the disclosure.
Figure 2:
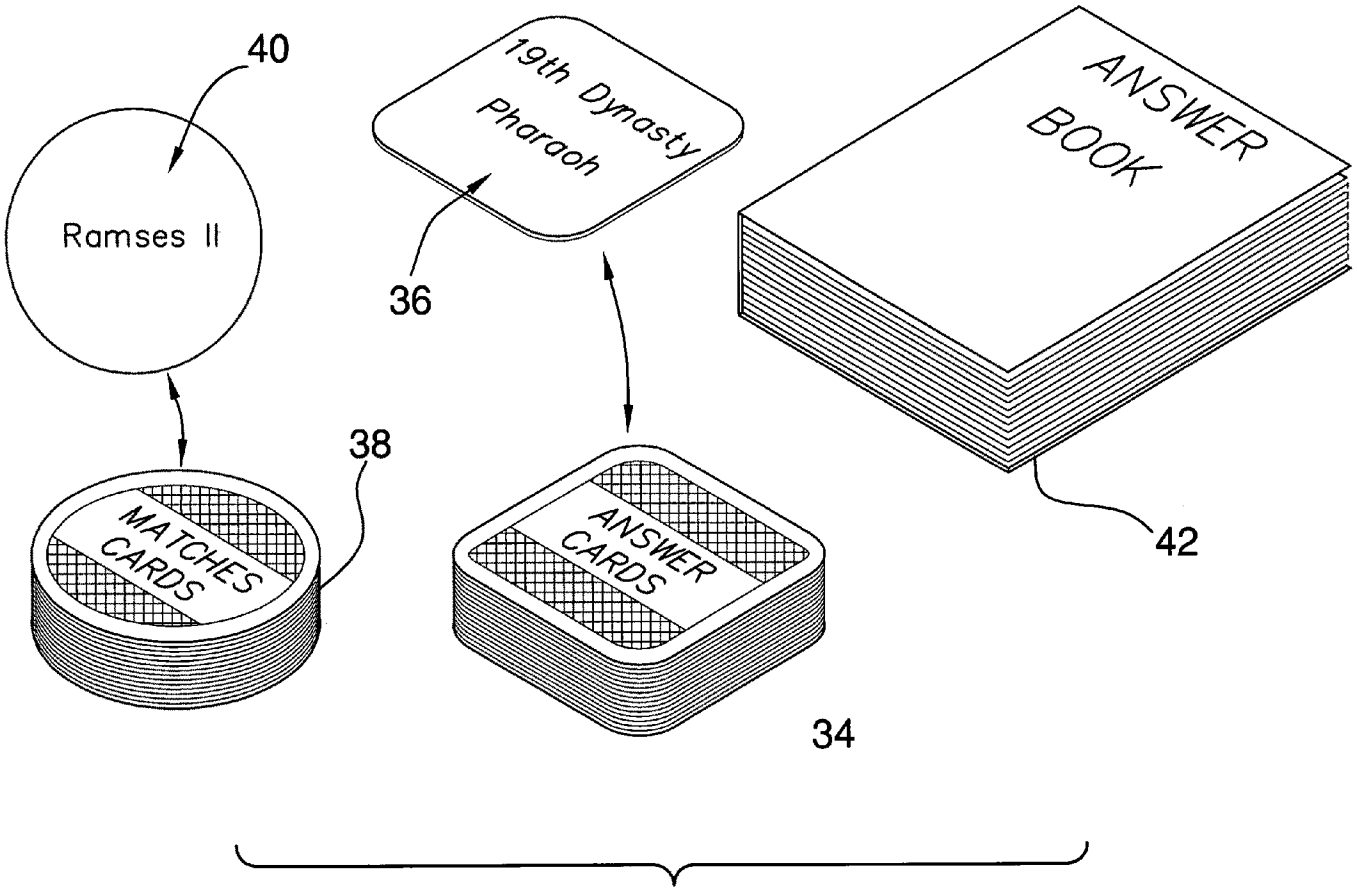
FIG. 2 is a perspective view of an embodiment of the disclosure.
Figure 3:
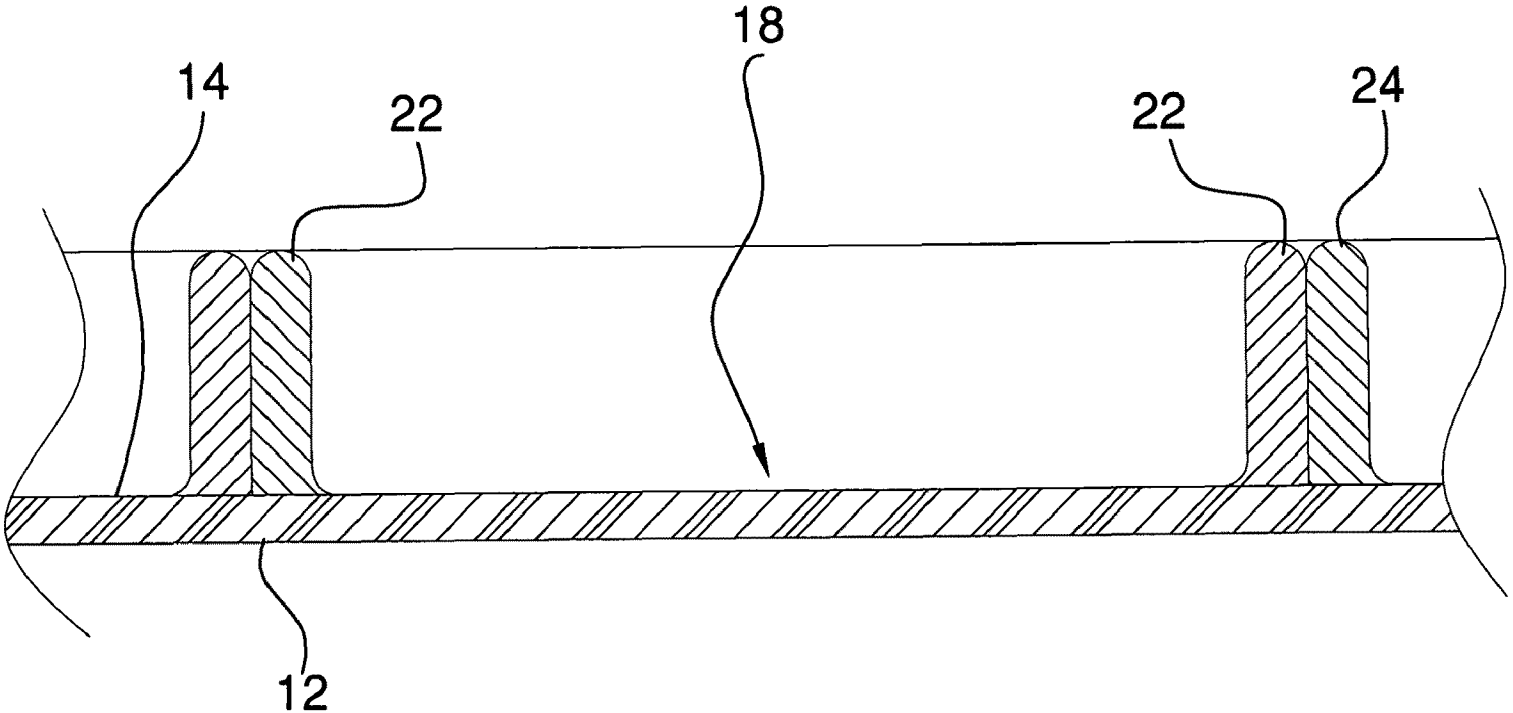
FIG. 3 is a cross-sectional view taken along line 3-3 of FIG. 1 of an embodiment of the disclosure.

With reference now to the drawings, and in particular to FIGS. 1 through 3 thereof, a new educational game embodying the principles and concepts of an embodiment of the disclosure and generally designated by the reference numeral 10 will be described.

As best illustrated in FIGS. 1 through 3, the educational game 10 and method generally comprises providing a game board 12 that has a top side 14 and a perimeter edge 16. A plurality of outer spaces 18 positioned on the top side 14 form an outer loop positioned adjacent to the perimeter edge 16 and a plurality of inner spaces 20 positioned on the top side 14 form an inner loop positioned within the outer loop. A quantity of the outer spaces 18 is equal to a quantity of inner spaces 20. Each of the outer spaces 18 has a first shape, such as rectangular, and each of the inner spaces has a second shape, such as circular. The outer 18 and inner 20 spaces each comprise a compartment that has a perimeter wall 22 extending upwardly from the top side 14 and extends around each of the inner 20 and outer 18 spaces.

Color indicia 24 are positioned on each of the outer 18 and inner 20 spaces so that each of the outer 18 and inner 20 spaces is colored one of a plurality of colors. The plurality of colors includes at least four colors. Each of the outer 18 and inner 20 spaces is colored one of the at least four colors. The inner and outer loops have a same number of each color so that each of outer spaces has a matching inner space. Point indicia 26 are positioned on each of the outer 18 and inner 20 spaces. Each of the point indicia 26 corresponds with one of the colors so that each of the colors includes point indicia 26 that are different than other ones of the colors. This is again so that each of the outer spaces 18 has a matching inner space 20.

A first spinner 26 and a second spinner 30 are each rotatably coupled to the game board 12. The first spinner 26 has an end 28 indicating one of the outer spaces 18 and the second spinner 30 has an end 32 indicating one of the inner spaces 20. The first 26 and second 30 spinners have a common rotational axis point and may either spin together and while being attached to each other, or they may spin freely with respect to each other. One embodiment would include the first 26 and second 30 spinners being attached to each other so that when the first spinner 26 indicates a particular outer space 18, the inner spinner 30 will indicate its corresponding and matching inner space 20.

A plurality of outer cards 34 is provided and positioned in the outer spaces 18 so that each of the outer spaces 18 has one of the outer cards 34 positioned therein. Each of the outer cards 34 has first information indicia 36 thereon that are unique to each outer card 34. A plurality of inner cards 38 is provided and positioned in the inner spaces 20 so that each of the inner spaces 20 has one of the inner cards 38 positioned therein. The inner cards 38 each have second information indicia thereon that is unique to each inner card 38 and corresponds to the first information indicia 36 on one of the outer cards 34. In other words, each of the outer cards 34 includes first indicia 36 that will correspond to the second indicia 40 on one of the inner cards 38. The inner 38 and outer 34 cards have a same shape as a corresponding one of the outer 18 and inner 20 spaces and each of the inner 38 and outer 34 cards is colored to match the color of the inner 20 and outer 18 spaces on which the inner 38 and outer 34 cards are placed. The first information indicia 36 may comprise either an answer or a question to a historical trivia question and the second information indicia 40 may comprise either an answer or a question corresponding to the first information indicia positioned on one of the outer cards. More particularly, the game 10 may be directed to a particular historical period and location such as, for example, ancient African history.

While the questions and answers may be in conventional form, they may instead be represented by related information. For example, a question may be presented as; "name an Egyptian $19^{th}$ dynasty pharaoh" and the answer could be "Ramses II." Alternatively, related informational cards would present the same as above such as; "an Egyptian $19^{th}$ dynasty pharaoh" with the other card again stating "Ramses II." Since the game 10 is to be used as a teaching device, this will allow the player to determine whether or not the two are a match based on whether or not they are related. This also allows a person who adds or alters inner 38 and outer 34 cards to the game 10 to tailor it to specific periods and information. Therefore, the outer cards 34 may include multiple references to a $19^{th}$ dynasty pharaoh while the inner cards 38 include multiple names of $19^{th}$ dynasty pharaohs.

To play the game 10, a game controller is selected who will verify whether or not indicia matches have been correctly identified. The game controller will have an answer medium 42, such as an answer book or sheet of answers, on which the matches will be listed. The game 10 is then played with two or more players.

The players then take turns going through a series of steps which include first spinning the first spinner 26 to indicate one of the outer spaces 18 and removing the outer card 34 positioned in the outer space 18 indicated by the first spinner 26 to define a removed outer card 34 and an empty outer space 18. Second, the player spins the second spinner 30 to indicate one of the inner spaces 18 and removes the inner card 38 positioned in the inner space 20 indicated by the second spinner 30 to define a removed inner card 38 and an empty inner space 20. The player next reads the first 36 and second 40 information indicia on the removed outer 34 and inner 38 cards to determine if the first 36 and second 40 information indicia corresponds with each other. The player declares a match if a player believes that the first 36 and second 40 information indicia read correspond with each other or places the removed inner 38 and outer 34 cards back in the empty outer 18 and inner 20 spaces if the player does not declare a match. Points are awarded to players who correctly declare a match as confirmed by the game controller. The points are determined by the point indicia 26 indicated on the empty inner 20 and outer 18 spaces. A player wins the game by accumulating a preselected number of points. If the points are awarded as shown on FIG. 1, the preselected number may be 100 points.

Variations of the game 10 primarily include use of the first 26 and second 30 spinners. If the first 26 and second 30 spinners are attached together and used together simultaneously (the first and second spins are done at the same time), the first 26 and second 30 spinners will always be aligned with outer 18 and inner 20 spaces which have a same color. The inner 38 and outer 34 cards may then be color matched with these spaces to ensure that the matches are more related than would otherwise be possible. For instance, in the examples above, a plurality of pharaohs may be listed across two or three dynasties. If each of these were printed, for instance, on red inner cards 38 and a plurality of pharaohs were printed on red outer cards 34, the player would have to be more familiar with the exact dynasty that the pharaoh was associated with.

In another version, if the first 26 and second 30 spinners are not coupled together, the player may be awarded points only when the colors for each indicated outer 18 and 20 inner spaces match. With this version, the players, in turn, may spin the first spinner 26 to see which color it indicates. The player then may be given a predetermined number of spins with the second spinner 30 to indicate the same color with the second spinner 30 which has already been indicated with the first spinner 26. If the player is unsuccessful in this endeavor, the next player in turn then spins the first spinner 26 followed by the second spinner 30 for up to the predetermined number of spins. The number of predetermined spins may be three spins with the second spinner 30. If the player achieves a color match between the first 26 and second 30 spinners before using all spins, the player does not need to use all of the spins.

Alternatively, the points will be awarded regardless of the matching of colors, however, the odds of an indicia match are much less in this scenario and therefore this version will likely play better with related indicia instead of question and answer indicia.

In both cases, the cards 34, 38 are typically placed back in their respective inner 18 and outer 20 spaces if no match is found, though some cards 34, 38 may be switched from one space to another space of a same color if there is no match in the hopes that the next time the spaces are indicated a match will occur. This will assist the players in increasing the overall speed of the game 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An educational game comprising:

a game board having a top side and a perimeter edge, a plurality of outer spaces being positioned on said top side and forming an outer loop positioned adjacent to said perimeter edge, a plurality of inner spaces being positioned on said top side and forming an inner loop positioned within said outer loop, a quantity of said outer spaces being equal to a quantity of inner spaces, each of said outer spaces having a first shape and each of said inner spaces having a second shape, each of said outer and inner spaces comprising a compartment having a perimeter wall extending upwardly from said top side;

color indicia being positioned on each of said outer and inner spaces so that each of said outer and inner spaces is colored one of a plurality of colors, said plurality of colors including at least four colors, each of said outer and inner spaces being colored one of said at least four colors, each of said inner and outer loops having a same number of each of said colors;

point indicia being positioned on each of said outer and inner spaces, each of said point indicia corresponding with one of said colors so that each of said colors includes a point indicia being different than other ones of said colors;

a first spinner and a second spinner each rotatably coupled to said game board, said first spinner having an end indicating one of said outer spaces and said second spinner having an end indicating one of said inner spaces, said first and second spinners having a common rotational axis point;

a plurality of outer cards being positioned in said outer spaces so that each of said outer spaces has one of said outer cards positioned therein, each of said outer cards having first information indicia thereon being unique to each outer card;

a plurality of inner cards being positioned in said inner spaces so that each of said inner spaces has one of said inner cards positioned therein, said inner cards having second information indicia thereon being unique to each inner card and corresponding to said first information indicia on one of said outer cards, said inner and outer cards having a same shape as a corresponding one of said outer and inner spaces, each of said inner and outer cards being colored to match the color of said inner and outer spaces on which the inner and outer cards are placed, said first information indicia comprising either an answer or a question to a historical trivia question, said second information indicia comprising either an answer or a question corresponding to said first information indicia positioned on one of said outer cards.

* * * * *